US006588068B1

(12) United States Patent
Wang

(10) Patent No.: US 6,588,068 B1
(45) Date of Patent: Jul. 8, 2003

(54) STRAP FASTENER OF SWIMMING FLIPPER

(76) Inventor: Ching-Wen Wang, No. 159, Cheng Kuon Road, San Chung City, Taipei County (TW)

( * ) Notice: Subject to any disclaimer, the term of this patent is extended or adjusted under 35 U.S.C. 154(b) by 0 days.

(21) Appl. No.: 10/073,946

(22) Filed: Feb. 14, 2002

(51) Int. Cl.[7] ..... A44B 11/10
(52) U.S. Cl. ..... 24/171; 24/194
(58) Field of Search ..... 27/268, 25, 712.5, 27/115 M, 136 R, 136 L, 171, 194

(56) References Cited

U.S. PATENT DOCUMENTS

| | | | | | |
|---|---|---|---|---|---|
| 565,396 | A | * | 8/1896 | Stansbury | 24/171 |
| 2,554,686 | A | * | 5/1951 | Steiner | 24/194 |
| 3,587,140 | A | * | 6/1971 | Gaylort | 24/194 |
| 3,872,550 | A | * | 3/1975 | Yang | 24/170 |
| 3,950,826 | A | * | 4/1976 | Knoll et al. | 24/171 |
| 4,934,030 | A | * | 6/1990 | Spinosa et al. | 24/194 |
| 6,185,794 | B1 | * | 2/2001 | Maggi | 24/170 |

FOREIGN PATENT DOCUMENTS

| | | | | | |
|---|---|---|---|---|---|
| JP | 2000004910 | A | * | 1/2000 | A44B/11/26 |
| WO | WO 200218020 | A1 | * | 3/2002 | A44B/11/12 |

* cited by examiner

*Primary Examiner*—James R. Brittain
(74) *Attorney, Agent, or Firm*—Rabin & Berdo, P.C.

(57) ABSTRACT

A strap fastener of a swimming flipper uses the resilience of a spring to press a wedge block of a wedge block set and a bevel of a main body to tightly depress the fastening strap of the swimming flipper. For fastening, the said flipper fastening strap goes vertically into the fastener to improve the fastening method of bending the traditional fastening strap reversely at 180°, to eliminate the situation of bending and cracking generated after a certain period of application and to increase the useful life of the present invention. Moreover, the fastening strap of the swimming flipper of the present invention goes vertically into the fastener, closely attaches to the main body of the swimming flipper and turns along with the direction of flowing water during swimming or diving to thereby reduce the water resistance and enhance the diving efficiency.

3 Claims, 6 Drawing Sheets

STRAP FASTENER OF SWIMMING FLIPPER

BACKGROUND OF THE INVENTION

1) FIELD OF THE INVENTION

The present invention relating to a strap fastener of a swimming flipper, more especially to a fastening strap requiring no reverse bending but easy to be fastened and adjusted, comprises a fastening strap vertically inserted into a fastener for fixedly clamping a wedge block disposed inside the fastener and a main body of the fastener; for adjusting the fastening strap, a pull ring withdraws the wedge block to move backwardly for releasing the fastening strap; thereby, the useful life of the present invention is increased and flowing water resistance is reduced during swimming or diving.

2) DESCRIPTION OF THE PRIOR ART

Accordingly, a fastener (a) of a strap fastener of a conventional swimming flipper, as shown in FIG. 1, is inserted into a fastening strap (b) through an end of a rolling wheel (a2), stretches reversely and outwardly after winding around the rolling wheel (a2) at 180°; a clamping tenon (a3) disposed on the surface of a main body (a1) of the said fastener (a) pushes against the convex crease (b1) on the surface of the fastening strap(b); when the user pulls the distal end of the fastening strap (b) toward the rear aspect of the rolling wheel (a2), the clamping tenon (a3) of the fastener (a) and the convex crease (b1) of the fastening strap (b) form a state of ratchet for reducing the length of the fastening strap (b) on the swimming flipper so as to generate the effect of tight pulling; when trying to loosening the fastening strap (b), the user has to push downwardly one end, disposed with a compression spring (a4), of the clamping tenon (a3) to make the front end of the clamping tenon (a3) detach from the state of pushing against the convex crease (b1) on the fastening strap (b) for loosening.

In the abovementioned structure, the said fastening strap (b) of the swimming flipper is inserted through the rolling wheel (a2) of a fastener of a conventional swimming flipper and reversely bended at 180° to stretch outwardly; when the user forcefully pulls the fastening strap (b) outwardly, the clamping tenon (a3) of the conventional fastener (a) pushes against the convex crease (b1) on the fastening strap (b) to form a fixed structure; however, in application of the said fixed structure, since the fastening strap (b) is reversely bended at 180° for fastening, the situation of damage or indentation caused by bending tends to occur; that increases the distance among the fastening strap (b), the clamping tenon (a3) and the rolling wheel (a2), thereby results in the shortcoming of uneasy fastening; furthermore, due to the abovementioned situation of application, the conventional fastening strap (b) might be damaged, cracked or broken to further reduce the useful life of the fastening strap (b) of the swimming flipper and increase the user's economic cost.

In addition, the fastening strap (b) of the conventional fastener (a) is disposed by bending two sides outwardly and reversely at 180°, as shown in FIG. 4 I and FIG. 5 I; therefore, in practical application, a resistance against the direction of flowing water is generated during swimming or diving to further increase the difficulty for the user to swim forwardly.

In view of the shortcomings of the fastener of the conventional swimming flipper that it might be damaged, bent, cracked or broken to not only make the tightening and fastening of the fastening strap difficult, but also increase the resistance to obstruct the user swimming forwardly, the inventor of the present invention researched and designed an innovative and improved strap fastener structure of a swimming flipper.

SUMMARY OF THE INVENTION

The primary objective of the present objective is to provide a strap fastener of a swimming flipper allowing a fastening strap to directly insert into a main body of the present invention for assembling and application so as to increase the useful life thereof.

The secondary objective of the present invention is to provide a strap fastener of a swimming flipper allowing the user to firmly tighten or specifically release the fastening strap of a swimming flipper by applying the present invention with less situation of damaging the fastening strap.

Another objective of the present invention is to provide a strap fastener of a swimming flipper allowing a fastening strap to be directly assembled onto the fastener allowing the strap fastener of the swimming flipper to be parallel to the flowing water direction of the swimming user so as to reduce the resistance of swimming forwardly.

To achieve the abovementioned objectives, the present invention of a strap fastener of a swimming flipper mainly inserts a fastening strap directly into a main body of the fastener and disposes a wedge block inside the said main body to press onto the fastening strap; with the cooperative action of a spring inside the main body, the said wedge block is capable of automatically clamping and fixing the fastening strap inside the fastener; through pulling a pull ring connected with the wedge block to pull the wedge block for pushing away the resistance of the spring and moving from the bevel end of the main body, the wedge block detaches the forced pressure and fixed fastening of the fastening strap so as to achieve the objective of releasing or adjusting the length of the fastening strap of the swimming flipper.

To enable a further understanding of the structure, disposition and the features of the present invention, the brief description of the drawings below is followed by the detailed description of the preferred embodiment.

BRIEF DESCRIPTION OF THE DRAWINGS

FIG. 3-1 is a cross-sectional drawing of the fixed assembly of the present invention.

FIG. 3-2 is a cross-sectional drawing of the adjustable assembly of the present invention.

FIG. 4-1 is a top plan view drawing of prior art structure.

FIG. 4-2 is a top plan view drawing of the present invention.

FIG. 5-1 is a schematic drawing of an exemplary embodiment of prior art structure.

FIG. 5-2 is a schematic drawing of an exemplary embodiment of the present invention.

DETAILED DESCRIPTION OF THE PREFERRED EMBODIMENTS

Figure 1:
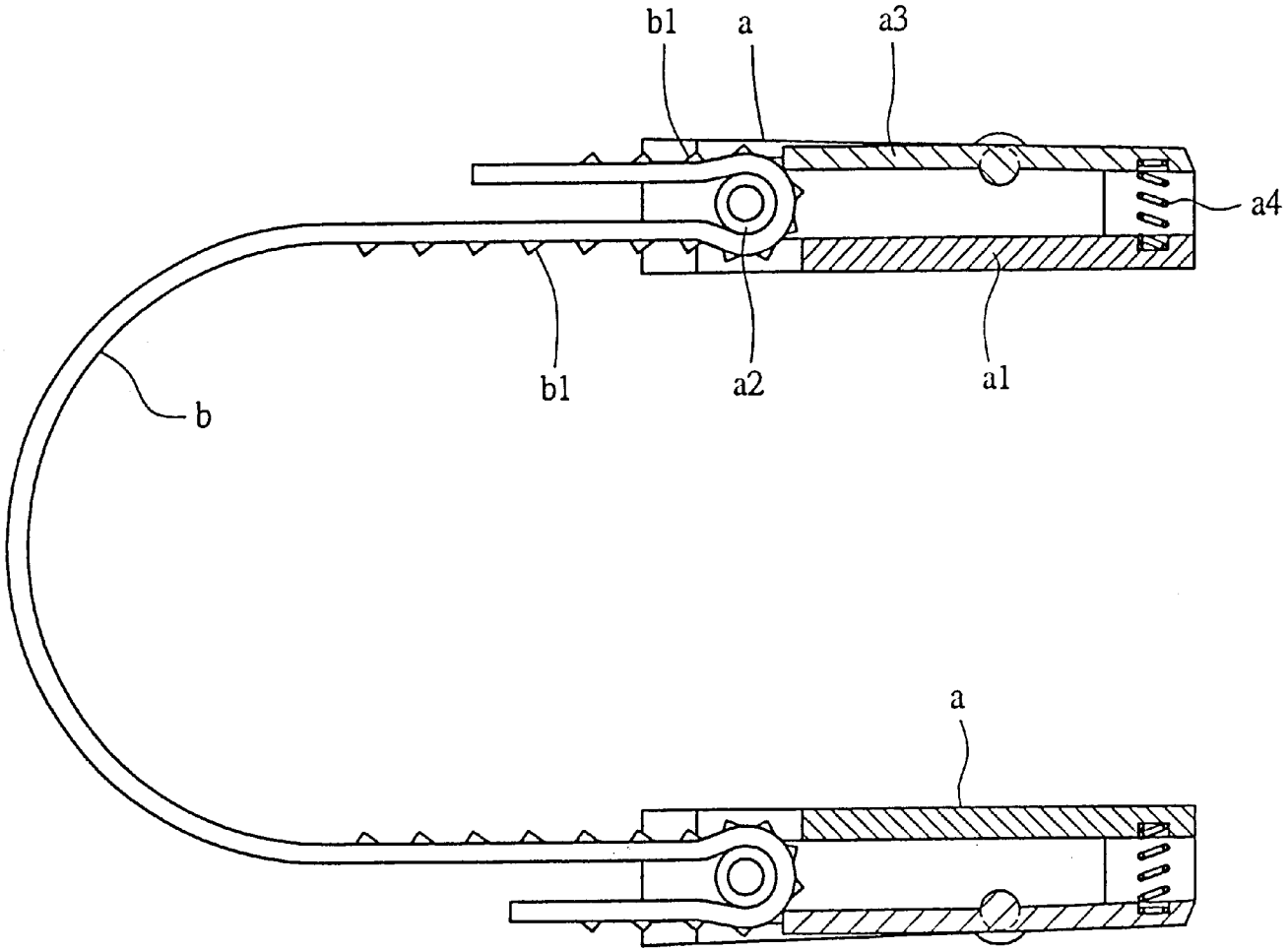
FIG.1 (PRIOR ART)
FIG. 1 is a cross-sectional drawing of the assembly of a fastener and a fastening strap of a conventional swimming flipper.
Figure 2:
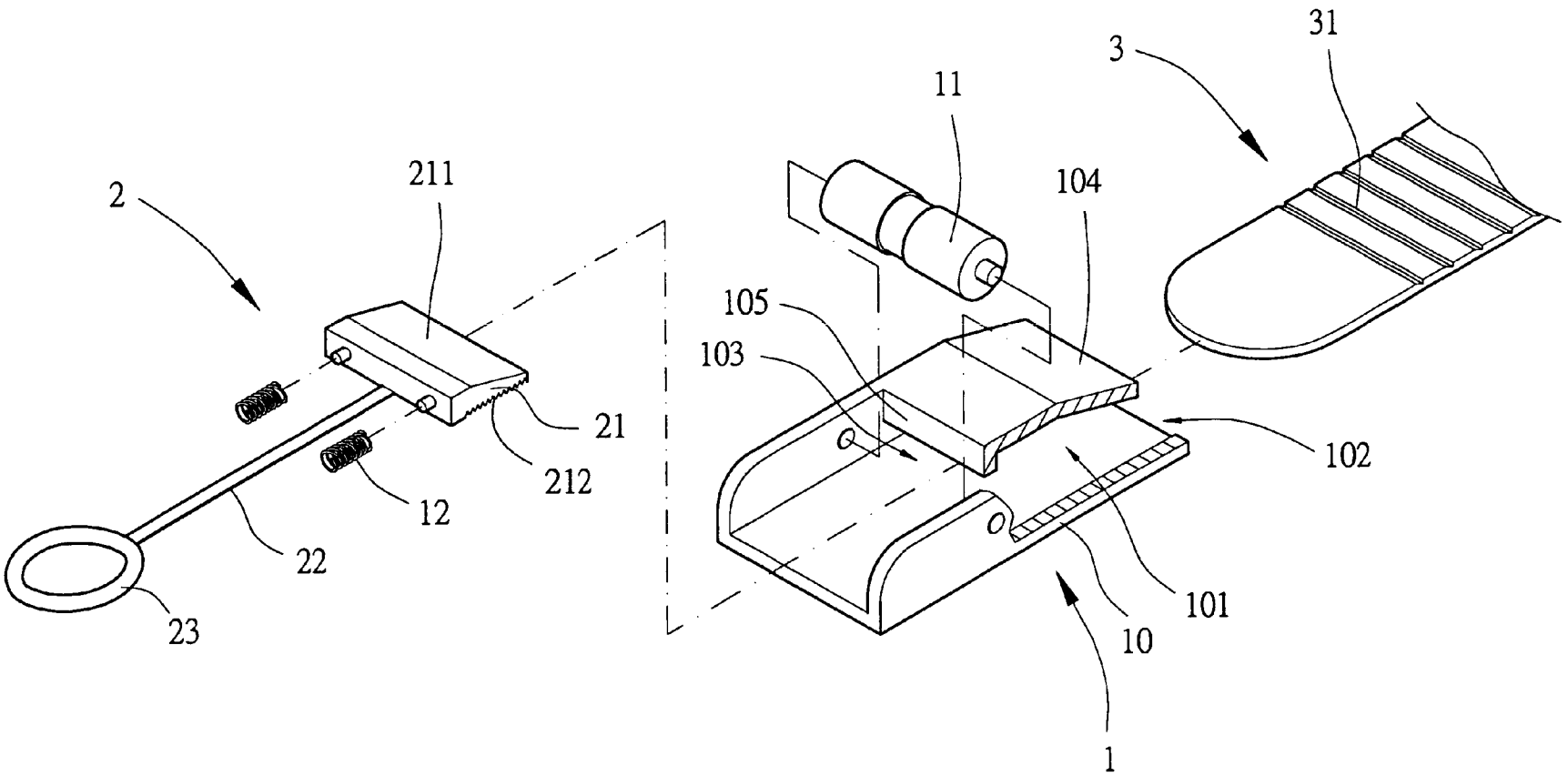
FIG. 2 is a pictorial and exploded drawing of the present invention.
Figure 3I:
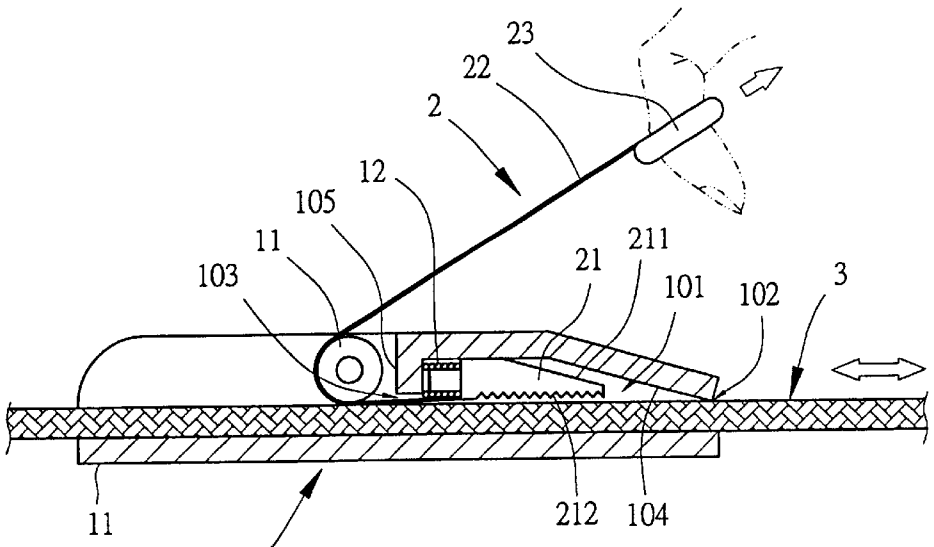
Figure 3:
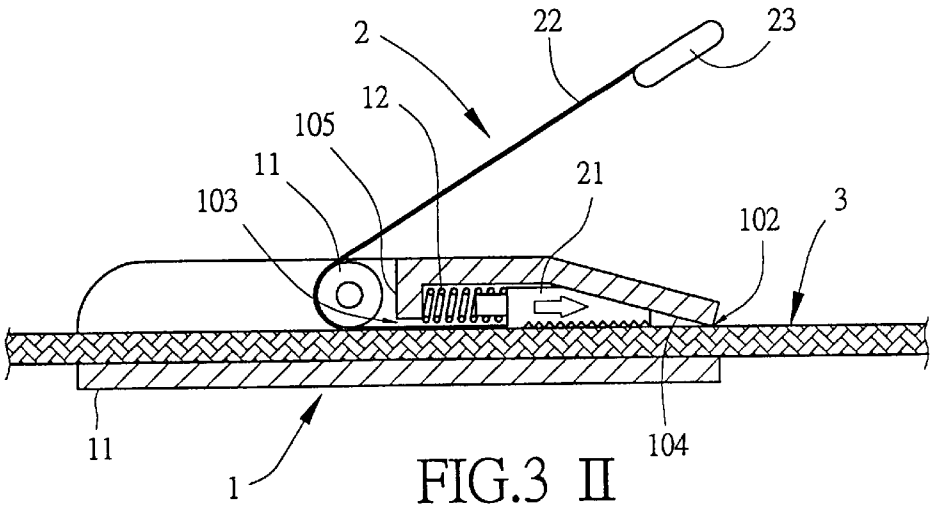
Figure 4:
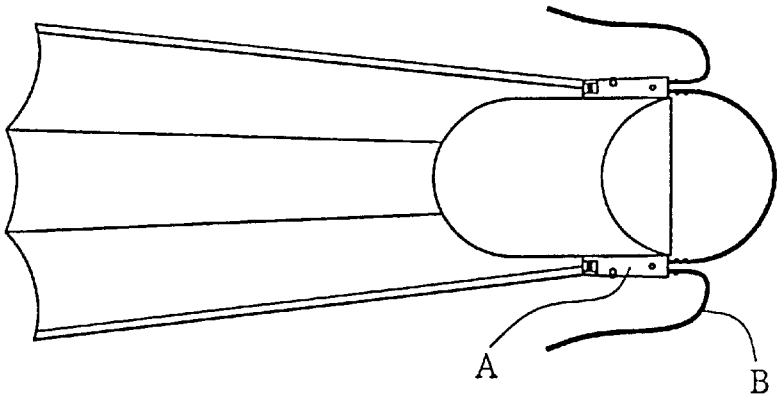
FIG.4 I (PRIOR ART)
Figure 4:
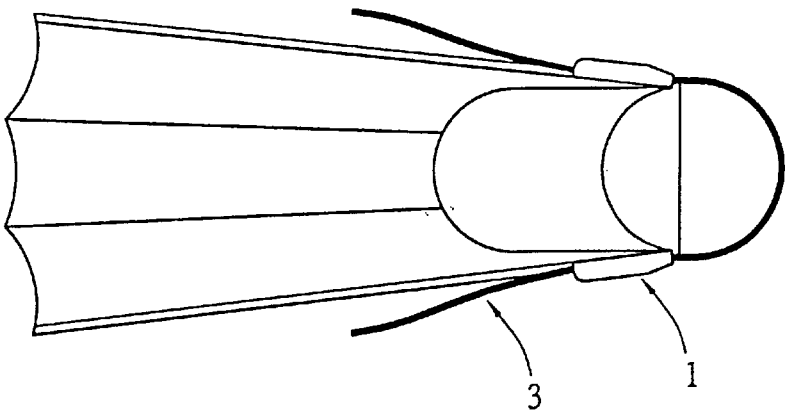
Figure 5:
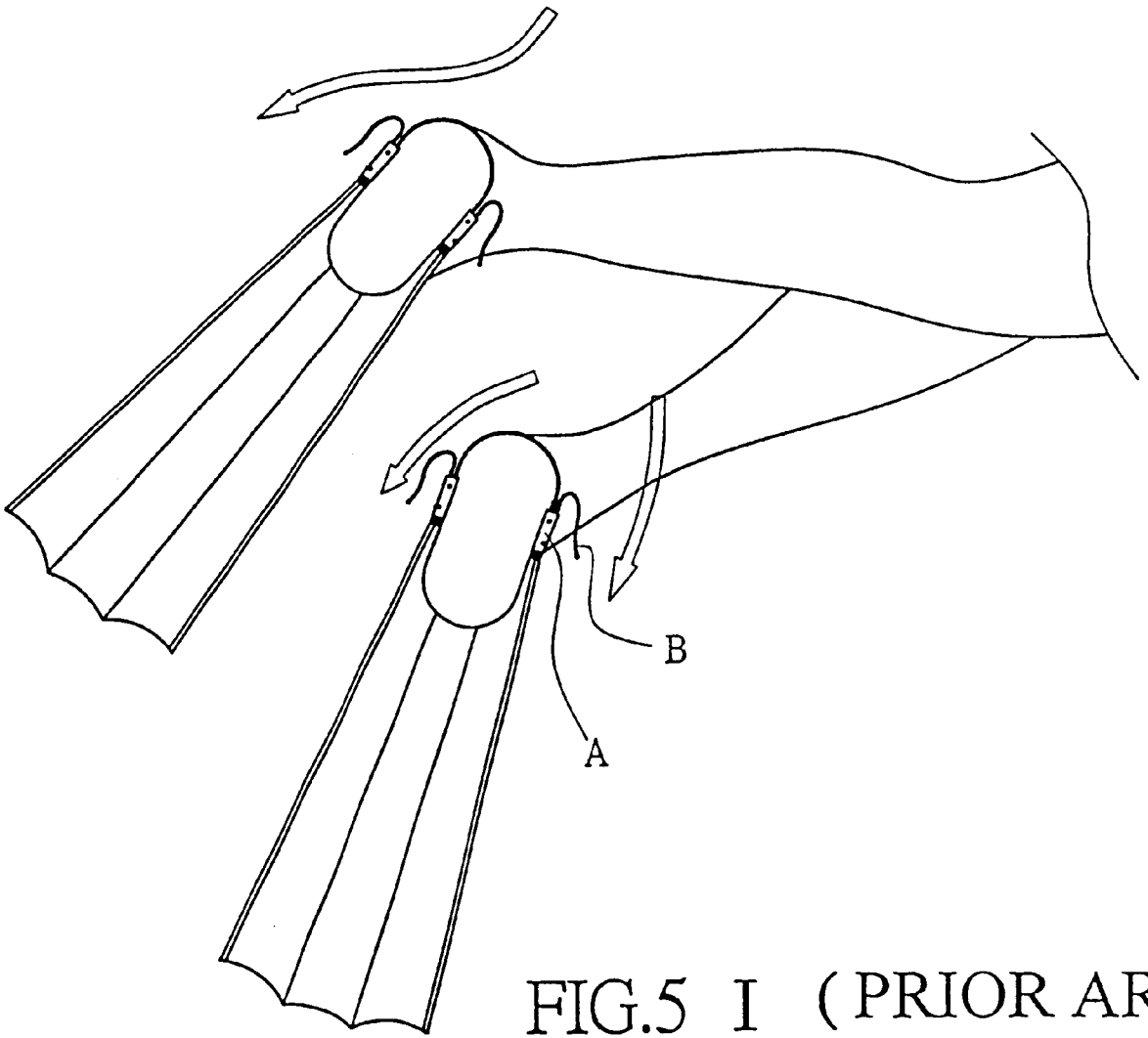
FIG.5 I (PRIOR ART)
Figure 5:
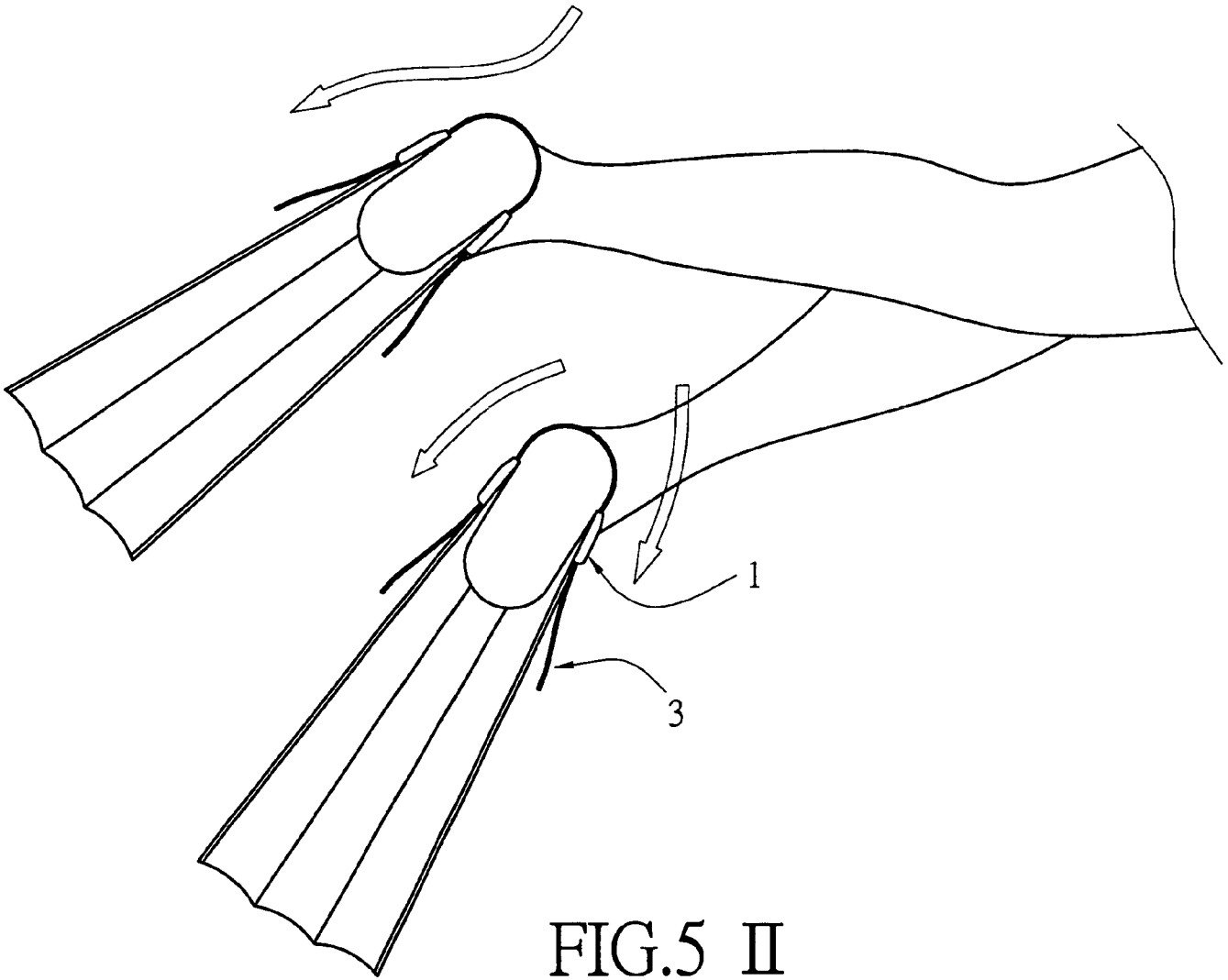

Referring to FIGS. 2, 3 and 4 II, the present invention a strap fastener of a swimming flipper mainly comprises a fastener (1), a wedge block set (2) and a fastening strap (3); wherein, the fastener (1) is fixed on one side of a swimming flipper (4) and includes a main body (10), a rolling wheel (11) and a spring (12); the said main body (10) has a slot chamber (101); openings (102, 103) are respectively disposed at two ends of the slot chamber (101); a downward bevel wall plane (104) is disposed at the area of the opening (102) at the front end; the opening (103) at the other end is a vertical wall plane (105); the rolling wheel (11) is pivotally disposed on the outer side of the vertical wall plane (105); the spring (12) pushing against the inner side of the vertical wall plane (105) is disposed inside the slot chamber (101) of the main body (10).

A wedge block set (2) comprises a wedge block (21), an extending strap (22) and a pull ring (23); the wedge block (21) with a bevel plane (211) corresponding to the bevel wall plane (104) of the fastener (1) is disposed inside the slot chamber (101) of the fastener (1) and pushed by the spring (12) therein; an anti-skid crease (212) is disposed on the bottom plane of the said wedge block (21); the rear end of the said wedge block (21) is connected with the pull ring (23) by the extending strap (22) and goes through the opening (103) at the rear end of the slot chamber (101) inside the fastener (1) and the bottom plane of the rolling wheel (11).

An anti-skid crease (31) is disposed at a proper area on the surface of the fastening strap (3) inserted through the opening (102) at the front end of the fastener (1), passed the bottom plane of the wedge block (21) and stretched outwardly from the opening (103) at the rear end and the bottom plane of the rolling wheel (11).

Referring to FIG. 3, in applying the abovementioned structural assembly, since the wedge block (21) disposed inside the slot chamber (101) in the fastener (1) is pushed fixedly and forwardly by the spring (12) therein, the said wedge block (21) generates a downward action in cooperation with the bevel wall plane (104) of the main body (10), therefore, it clamps and fixes the fastening strap (3) at the lower aspect thereof; pulling the fastening strap (3) outwardly from one end of the opening (102) at the front end drives the wedge block (21) to move forwardly and further for tighter fastening; therefore, once being firmly fastened, the fastening strap (3) does not easily and automatically get loosened.

Furthermore, trying to adjusting the length (tightness) of the fastening strap (3), the user pulls the pull ring (23) backwardly to make the wedge block (21) withdraw backwardly from the bevel wall plane (104); at this time, the wedge block (21) obtains more space and releases its pressure toward the fastening strap (3); therefore, the length of the fastening strap (3) can be easily adjusted.

Referring to FIGS. 4 I, II, 5 I and II, since the said fastening strap (3) is assembled vertically inside the fastener (1), it does not has the shortcomings of a conventional structure requiring a 180° bending for fastening; in addition, being applied for practical swimming, the fastening strap (3) of the present invention is vertically parallel to the swimming flipper (4), that means, it faces toward the same direction of the flowing water; therefore, the resistance of flowing water generated during swimming is reduced and that is different from the conventional structure.

In summation of the abovementioned, the present invention of a strap fastener of a swimming flipper is capable of not only specifically achieving the effect of easily fastening and adjusting the length of the swimming flipper in use, but also eliminating the damage and bending of the fastening strap as well as reducing the resistance of flowing water.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A strap fastener of a swimming flipper mainly comprises a fastener, a wedge block set and a fastening strap; wherein, the fastener is fixed on one side of a swimming flipper and includes a main body, a rolling wheel and a spring; the said main body has a slot chamber; an opening is respectively disposed on two ends of the slot chamber; a downward bevel wall plane is disposed at the area of the opening at the front end; the opening at the other end is a vertical wall plane; the rolling wheel is pivotally disposed on the outer side of the vertical wall plane; the spring pushing against the inner side of the vertical wall planes is disposed inside the slot chamber of the main body;

the wedge block set comprises a wedge block, an extending strap and a pull ring; the wedge block with a bevel plane corresponding to the bevel wall plane of the fastener is disposed inside the slot chamber of the fastener and pushed by the spring therein; the rear end of the said wedge block is connected with the pull ring by the extending strap and goes through the opening at the rear end of the slot chamber inside the fastener and the bottom plane of the rolling wheel;

the fastening strap inserts through the opening at the front end of the fastener, passes the bottom plane of the wedge block and stretches outwardly from the opening at the rear end and the bottom plane of the rolling wheel.

2. A strap fastener of a swimming flipper according to claim 1, wherein, an anti-skid crease is disposed on the bottom plane of the wedge block.

3. A strap fastener of a swimming flipper according to claim 1, wherein, an anti-skid crease is disposed at a proper area on the surface of the fastening strap of the swimming flipper.

* * * * *